US010779070B2

(12) United States Patent
Staton et al.

(10) Patent No.: US 10,779,070 B2
(45) Date of Patent: Sep. 15, 2020

(54) THERMAL PADS

(71) Applicant: NEWTONOID TECHNOLOGIES, L.L.C., Liberty, MO (US)

(72) Inventors: Fielding B. Staton, Liberty, MO (US); David Strumpf, Columbia, MO (US)

(73) Assignee: NEWTONOID TECHNOLOGIES, L.L.C., Liberty, MO (US)

( * ) Notice: Subject to any disclaimer, the term of this patent is extended or adjusted under 35 U.S.C. 154(b) by 0 days.

(21) Appl. No.: 16/243,861

(22) Filed: Jan. 9, 2019

(65) Prior Publication Data

US 2019/0215594 A1 Jul. 11, 2019

Related U.S. Application Data

(60) Provisional application No. 62/616,297, filed on Jan. 11, 2018.

(51) Int. Cl.
*H04R 1/10* (2006.01)
*A41D 19/00* (2006.01)

(52) U.S. Cl.
CPC ..... *H04R 1/1008* (2013.01); *H04R 1/1091* (2013.01); *A41D 19/0024* (2013.01); *A41D 2400/12* (2013.01); *H04R 2201/10* (2013.01)

(58) Field of Classification Search
CPC ..... A41D 19/0024; A41D 2400/12; H04R 1/1008; H04R 1/1091; H04R 2201/10
USPC ..... 381/74, 367, 370, 374, 378, 371, 380; 704/500, E19.001; 219/492
See application file for complete search history.

(56) References Cited

U.S. PATENT DOCUMENTS

| | | | | |
|---|---|---|---|---|
| 8,442,258 | B2 | 5/2013 | Kimura | |
| 8,774,441 | B2 | 7/2014 | Miyazawa | |
| 9,258,636 | B2 | 2/2016 | Nakano et al. | |
| 9,479,855 | B2 | 10/2016 | Huang | |
| 9,613,614 | B2 | 4/2017 | Huang | |
| 9,699,541 | B2 | 7/2017 | Tsubone | |
| 2005/0016989 | A1 | 1/2005 | Kanel et al. | |
| 2007/0163571 | A1* | 7/2007 | Sereboff | G10K 11/165 126/599 |
| 2011/0119065 | A1 | 5/2011 | Pietrusko et al. | |
| 2015/0382094 | A1* | 12/2015 | Grinker | H04R 1/1016 381/380 |
| 2016/0277852 | A1* | 9/2016 | Lee | H04R 25/405 |
| 2017/0060177 | A1 | 3/2017 | Rahim et al. | |
| 2017/0099539 | A1 | 4/2017 | Di Censo et al. | |

FOREIGN PATENT DOCUMENTS

| | | | |
|---|---|---|---|
| KR | 20170103487 A | * | 9/2017 |
| WO | 2017040741 A1 | | 3/2017 |

OTHER PUBLICATIONS

PCT Application No. PCT/US2019/012905, International Search Report and Written Opinion, dated Mar. 21, 2019, 9 pages.

* cited by examiner

*Primary Examiner* — Vivian C Chin
*Assistant Examiner* — Friedrich Fahnert
(74) *Attorney, Agent, or Firm* — Avant Law Group, LLC

(57) ABSTRACT

An interactive device includes a housing, configured to be positioned on or adjacent a heat-receiving surface. The housing includes a plurality of controlled-response elements for outputting heat in response to the controlled-response elements receiving a first energy input.

16 Claims, 5 Drawing Sheets

THERMAL PADS

CROSS-REFERENCE TO RELATED APPLICATIONS

This application claims priority to U.S. Provisional Patent Application No. 62/616,297, filed Jan. 11, 2018, the disclosure of which is incorporated herein by reference in its entirety.

FIELD OF THE INVENTION

The present disclosure relates to interactive pads, which may be (but are not necessarily) incorporated into devices worn by a person such as articles of clothing, personal adornments, etc. In one embodiment, a headphone has a heating element that is thermo-reactive to vibrations such as sound waves.

SUMMARY OF THE INVENTION

The following presents a simplified summary of the invention in order to provide a basic understanding of some aspects of the invention. The summary is not an extensive overview of the invention. It is not intended to identify critical elements of the invention or to delineate the scope of the invention. Its sole purpose is to present some aspects of the invention in a simplified form as a prelude to the more detailed description that is presented elsewhere herein.

According to one embodiment, an interactive device includes a housing, configured to be positioned on or adjacent a heat-receiving surface. The housing includes a plurality of controlled-response elements for outputting heat in response to the controlled-response elements receiving a first energy input.

In one aspect of the invention, the interactive device is headphones. In another aspect of the invention, the interactive device is a glove. In still other aspects of the invention, the interactive device is any device for proving heat to a desirable surface.

According to another embodiment, headphones include a speaker for creating sound waves, and an ear pad configured to be positioned on or around an ear of a wearer. The ear pad has a plurality of controlled-response elements for outputting heat to the wearer in response to the controlled-response elements receiving sound waves created by the speaker.

DETAILED DESCRIPTION

Embodiments of thermal pads are described herein. Examples are provided to help with the understanding of the invention, but should not be considered limiting. The concepts presented herein can be translated to a number of different devices as shall be understood by those of skill in the art.

Figure 1:
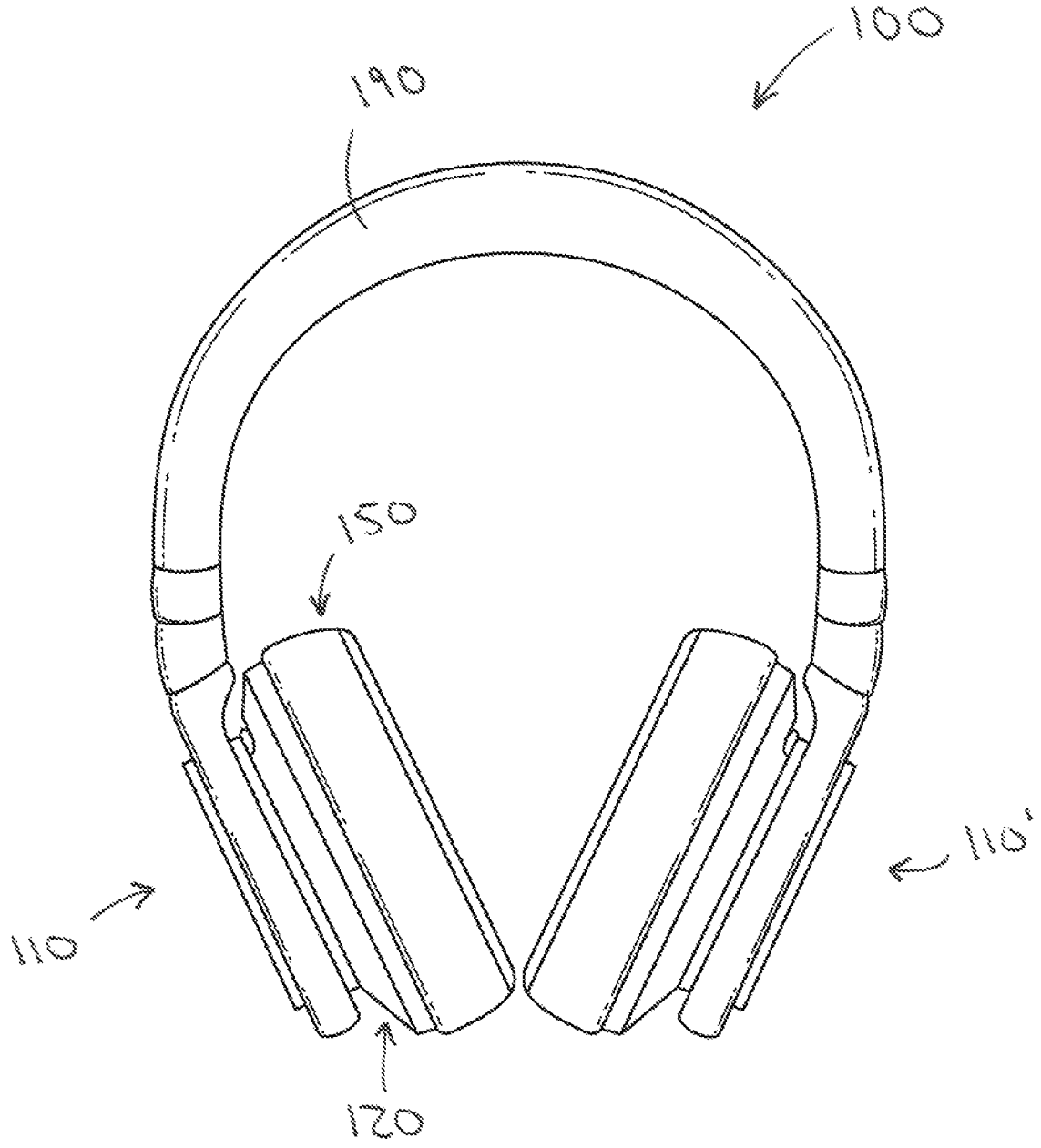
FIG. 1 is a rear view of headphones according to an embodiment of the disclosure.
Figure 2:
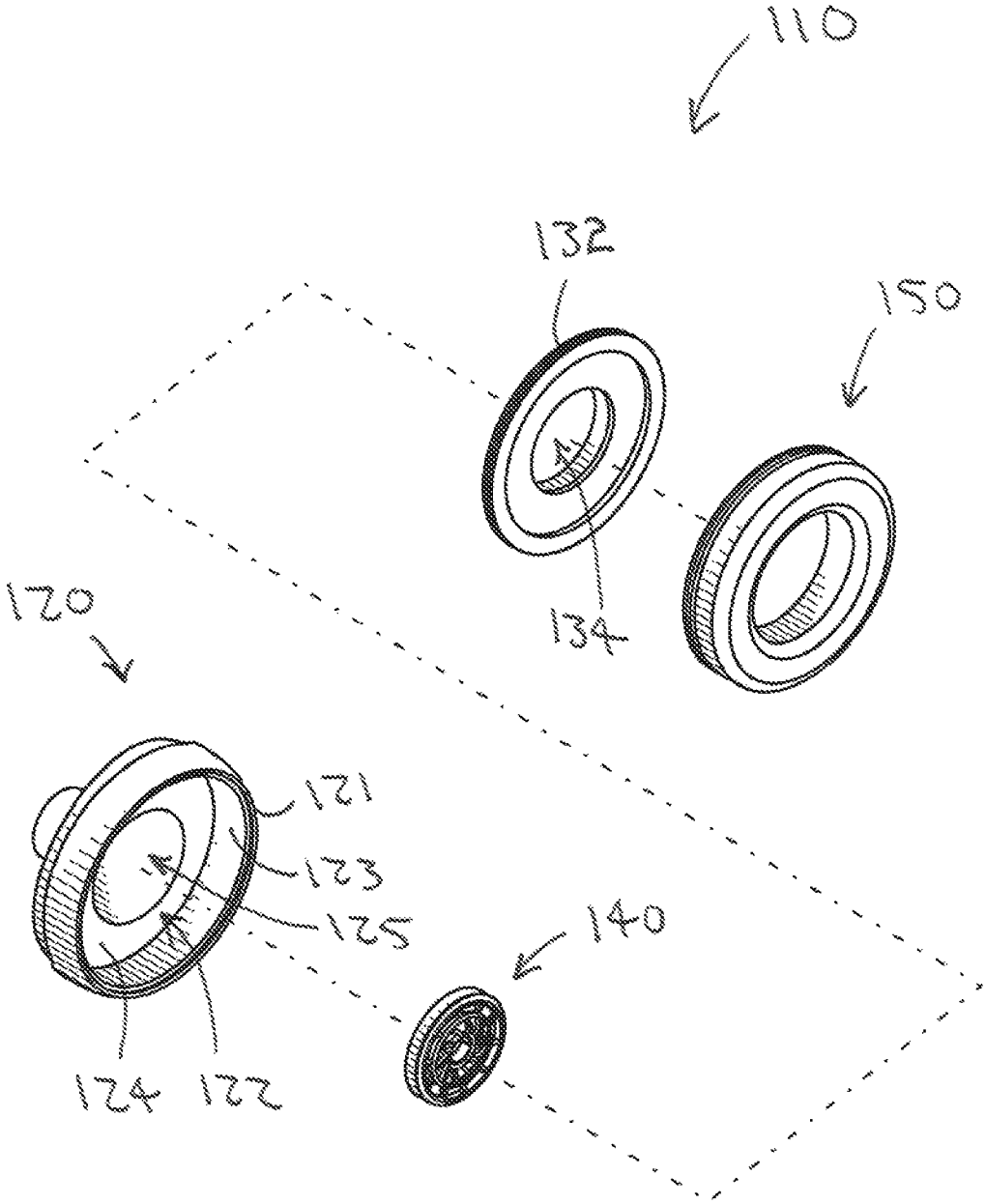
FIG. 2 is a partial exploded view of the headphones of FIG. 1.
Figure 3:
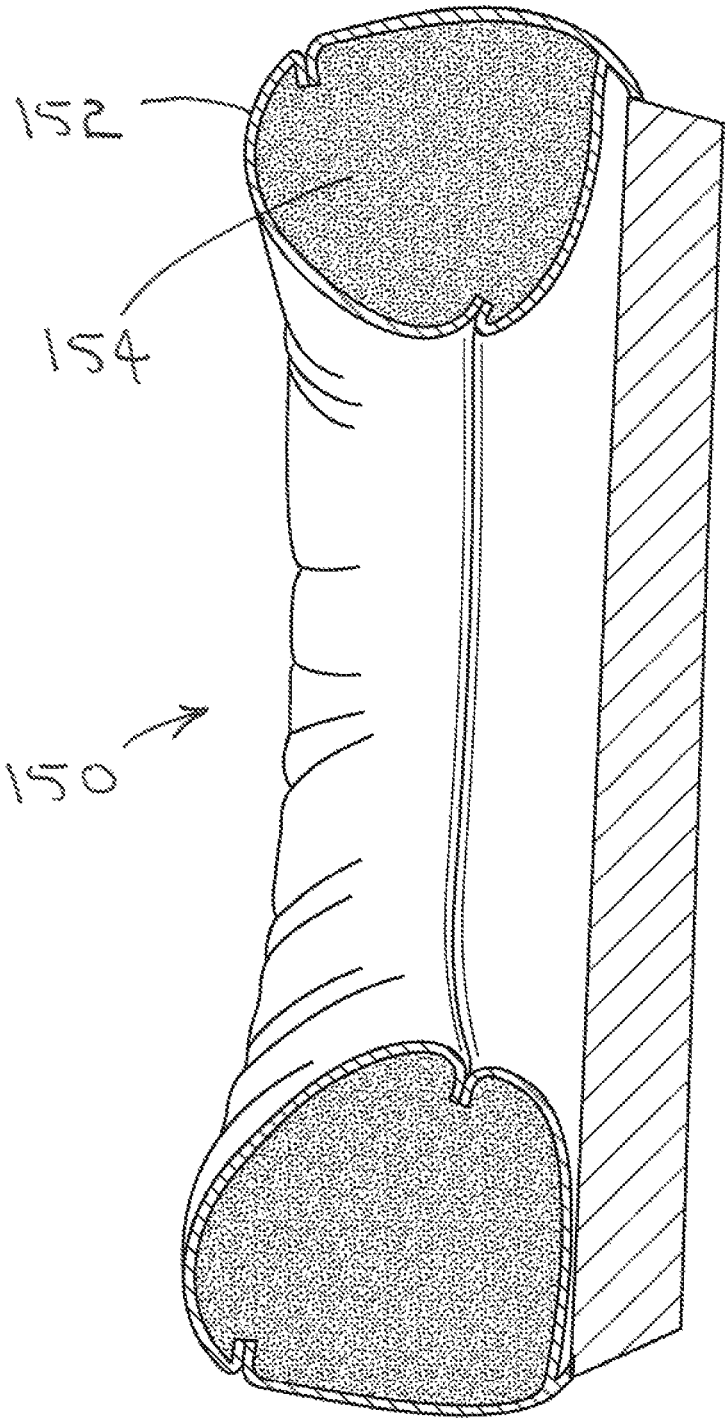
FIG. 3 is a cross section view of an ear pad of the headphones of FIG. 1.
Figure 4:
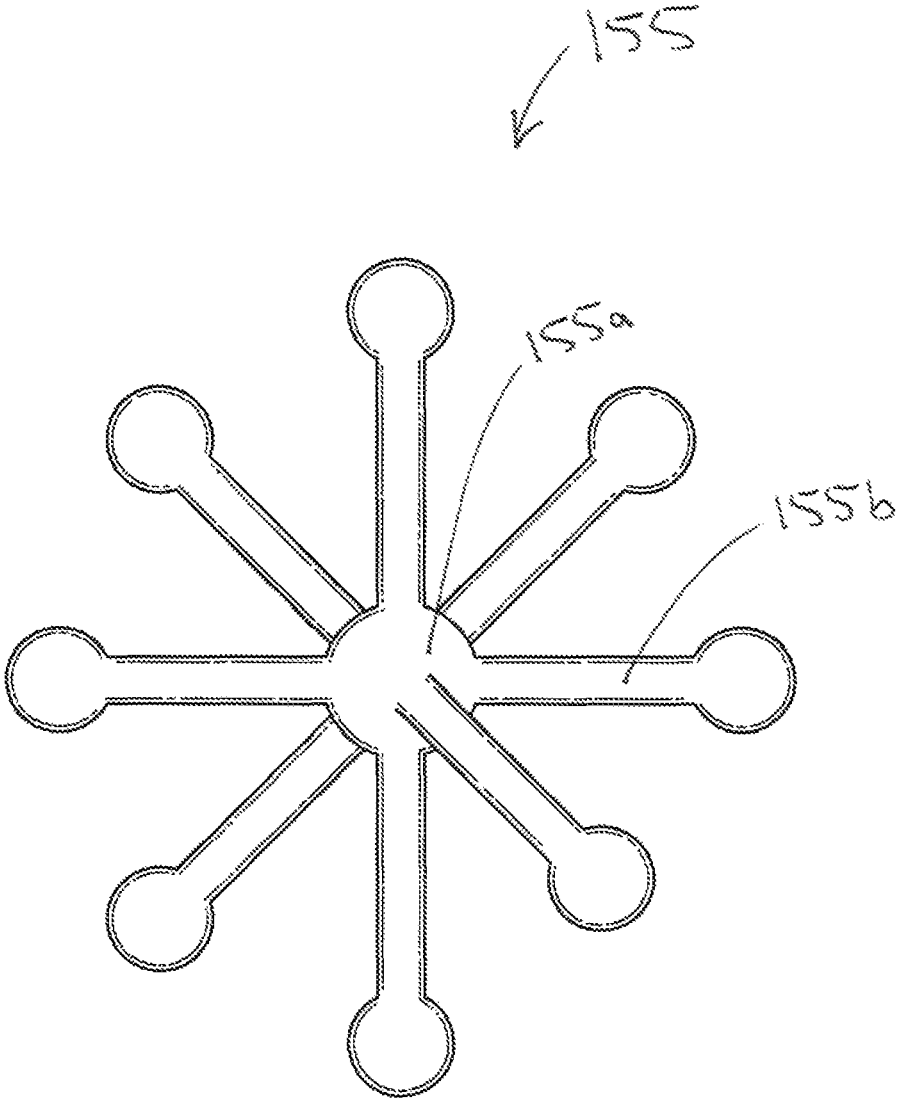
FIG. 4 is a perspective view of one type of controlled-response element appropriate for use in the headphones of FIG. 1.

According to one embodiment of the invention, illustrated in FIGS. 1 through 3, headphones 100 are adapted to be worn by a user. The headphones 100 include a left-ear unit 110 and a right-ear unit 110', which are connected by a band 190. The band 190 of the embodiment 100 is configured to extend atop the head of the user, and may be fixed or adjustable as is known in the art. The band 190 may alternately be a headband configured to extend around a circumference of the head, a hat covering some or all of the head, a visor, a scarf around the neck, a bracelet around the wrist, a warmer on a display panel, a circuit board thermal stabilizer, et cetera. The left-ear unit 110 is configured to be arranged on a left ear of the user wearing the headphones 100, and the right-ear unit 110' is configured to be arranged on a right ear of the user wearing headphones 100. The left and right ear units 110, 110' may preferably have symmetrical or mirror-image shapes and be substantially similar; the following description is given for the left-ear unit 110 and similarly applies for the right-ear unit 110' unless otherwise noted, shown, or inherent. Moreover, in some embodiments, only a left-ear unit 110 or a right-ear unit 110' is present without the other.

In the embodiment 100, the left-ear unit 110 is generally circularly shaped, but may be any suitable geometric shape in other embodiments. The left-ear unit 110 includes a housing 120, a speaker 140, and an ear pad 150. The speaker housing 120 may have a one-piece construction or may be formed of multiple pieces, based on such factors as cost and ease of manufacture. The housing 120 has a cavity 122 extending from one side 121 and may, for example, have a shape of a circular case or a hollow puck. The cavity 122 is bordered by sidewall 123 and end wall 124, and a second cavity 125 may extend from the cavity 122. The second cavity 125 may be useful for housing various components, such as a power source which may power components in one or both of the left and right ear units 110, 110'. A baffle plate 132 covers the cavity 122 and may have a generally complementary shape to the sidewall 123 (e.g., a circular or disc-like shape). The plate 132 may be permanently or removably coupled to the other portions of the housing 120 using any appropriate apparatus or method, whether now known or later developed, such as complementary threading, welding, adhesive, et cetera. The plate 132 includes at least one sound output hole 134 in communication with the cavity 122, and it may be desirable for the sound output hole 134 to be disposed in the center of the plate 132. The speaker 140 may be positioned within or adjacent the output hole 134, and the speaker 140 and the output hole 134 may be sized or otherwise configured (e.g., with flanges) such that the speaker 140 cannot undesirably pass entirely through the output hole 134.

The speaker 140 outputs sound waves when actuated, and may be any speaker now known or later developed. For example, a front (or user-facing) side of a speaker 140 well known in the art includes a diaphragm which has a fixed outer perimeter and a movable inner area coupled to a voice coil. The voice coil sits in front of a permanent magnet, and electrical signals pass through the voice coil—turning the coil into an electromagnet which either attracts or repels the permanent magnet, moving the coil (and the inner area of the diaphragm) backwards and forwards. Alternative displacement movements of the speaker 140 may be provided by the displacement of a ceramic-piezo, polymer-piezo or carbon nanostructure film diaphragm. Movement of the diaphragm result in sound wave propagation to the localized atmosphere through cycles of compression and rarefication of air. Air may consist of naturally occurring mixtures or intentionally fortified composites such as nitrogen, oxygen, or strategically selected inert materials (e.g. gases, liquids, gels, semi-fluids, or semi-solids).

The ear pad 150 is generally annular and overlies the baffle plate 132 for contacting a user on or around the user's ear. As shown in FIG. 3, the ear pad 150 may have outer and inner layers 152, 154. The outer layer 152 may be made, for example, of natural or synthetic leather, foam, vinyl, cotton, or other fabrics. It may be preferred for the outer layer 152 to allow heat to pass therethrough, and some embodiments may omit the outer layer 152 altogether. The inner layer 154 includes compositions selected to provide a controlled response to stimulus (in the embodiment 100, audio waves). The composition may include a carrier medium and a plurality of controlled-response elements, which may be uniformly distributed in the carrier medium, or may be strategically positioned at certain locations in the carrier medium to provide the desired response at select locations of the ear pad 150. The controlled-response elements may, for example, include three-dimensional (3D) nanostructures 155 having a core 155*a* and a plurality of spokes 155*b* extending radially outwardly from the core 155*a*. The spokes 155*b* may extend outwardly at a variety of angles. Other such nanostructures 155 may for example include C-60, carbon nanotubes, graphene, silicon nanotubes, cadmium zinc nanotubes, and the like. It may be particularly desirable for the controlled-response elements to vibrate and create a frictional force when introduced to sound waves (e.g., from the speaker 140), ultimately outputting heat. Depending on such factors as distribution of the controlled-response elements in the carrier medium and the insulating properties of the carrier medium, heat generated by vibration of the controlled-response elements may be localized in the ear pad 150 or dissipated throughout the ear pad 150. The heat in the ear pad 150 may be soothing to the wearer, and particularly when used in cold environmental ambient conditions. In some embodiments, the inner layer 154 includes multiple types of controlled-response elements, selected to jointly provide the desired output (e.g., warming, subsonic, ultrasonic, haptic, harmonic waveforms).

While the embodiment 100 includes a device (i.e., the speaker 140) which triggers the response of the controlled-response elements, other embodiments may forego such triggering devices; in such embodiments, the trigger may be environmental. For example, if the trigger is the introduction of sound waves, such sound waves may be created by sources not directly coupled to the device. In embodiments, a portion of the controlled-response elements may be selectively tunable to a particular frequency such that the vibration of the controlled-response elements enhances the sound from the speaker(s) 140, for example. Such influence on the controlled-response elements may be provided by controlling the reaction of a portion of the controlled-response elements to outside energy (e.g., not energy as a result of the sound waves, supplemental, unintentional ambient energy) to the ear pad 150.

The portion of the controlled-response elements may be tuned to receive and react to the outside energy, for example, by providing a reaction (such as vibrations) in such a way to counteract the outside energy. Thus, the pad 150 may be equipped with one or more sensors configured to detect the frequency of the outside energy, and activate the portion of the controlled-response elements in accordance with the detected frequency. In another example, the portion of the controlled-response elements may be reoriented to block (filter or partially block) the passing of the outside energy through the pads 150. Accordingly, one portion of the controlled-response elements may be tuned to enhance one frequency (e.g., the sound waves from the speaker 140) while another portion is tuned to block another frequency. Of course, the controlled-response elements can be configured to adjust to additional frequencies as necessary or desired.

The ear pad 150 may be integral to the headphones 100, or it may be a separate add-on component. Where the ear pad 150 is integral to the headphones 100, the ear pad 150 may be connected directly to the energy source for the headphones 100. The energy source may provide the energy necessary to effectuate the tuning of the controlled-response elements. Where the ear pads 150 are separate from the headphones 100, the ear pad 150 may be provided with a connector (e.g., a 3.5 mm connector) for plugging the ear pad 150 into the headphones 100. In still another embodiment, the ear pad 150 may be provided with a standalone energy source for providing outside energy thereto (e.g., a battery). The amount of energy to the ear pad 150 may be controlled by a controller located on the headphones 100 or the ear pad 150, as the case may be. The controller may be configured to control all and/or various portions of the controlled-response elements. In embodiments, the ear pad 150 may be wirelessly connected to a user's device (e.g., smartphone, watch, laptop, visor, glasses), and the user may engage with the device in order to control the application of energy to influence the controlled-response elements.

The ability to influence the controlled-response elements may be particularly useful where the headphones 100 are utilized in multiple environments. Because the controlled-response elements may be tunable to a particular resonant frequency, the user may be able to selectively increase and decrease the response of the controlled-response elements to the amount of energy applied to the ear pads 150, which may be both a result of the soundwaves (e.g., from the speaker 140 and/or noise from the environment). For example, in a crowded room, the response of a portion of the controlled-response elements can be adjusted to block out the unwanted noise, while in a quiet room, all of the controlled-response elements may be focused on enhancing the sound from the speakers 140.

Figure 5:
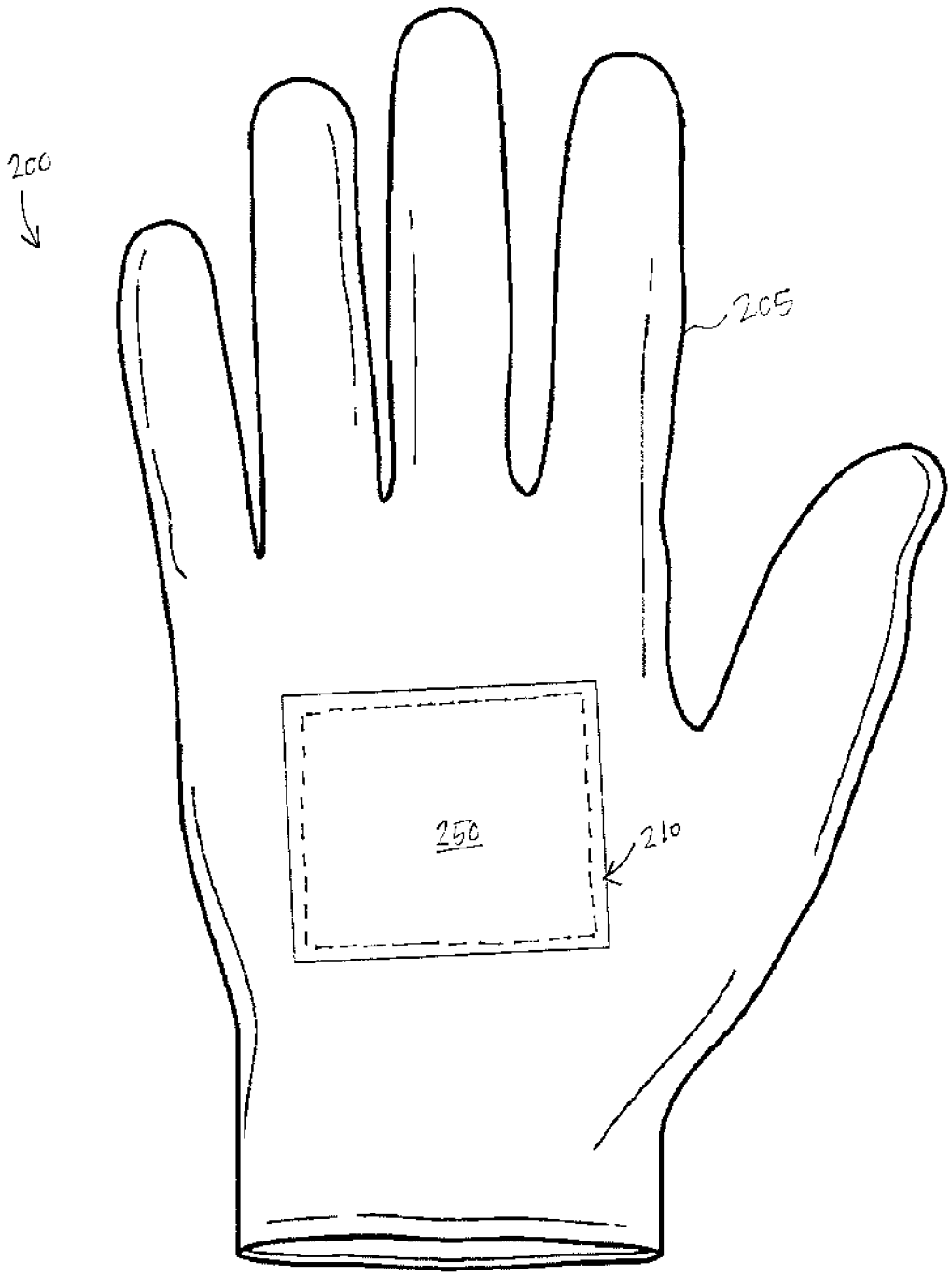
FIG. 5 is a perspective view of a glove according to another embodiment of the disclosure.

As noted above, pads can be incorporated for use in other devices as well. According to another embodiment 200, illustrated in FIG. 5, a glove 205 is equipped with a pocket 210 for receiving a thermal pad 205. The thermal pad 250 is substantially similar to pad 150, except as shown or as would be inherent. Like pad 150, the thermal pad 250 includes an inner layer with compositions selected to provide a controlled response to stimulus as described herein. The pad 250 may optionally include an outer layer. The controlled-response elements operate in conjunction with one another to jointly provide the desired output. In embodiments, the desired output is heat, although other outputs (e.g., vibrations, electrical impulses, etc.) are also contemplated within the scope of the invention.

The controlled-response elements are triggered by the input of energy to the pad 250. As mentioned herein, the input may be from a device (e.g., a battery) or it may be environmental. In one embodiment, the input may simply be movement of the glove, such as the natural movement of a wearer of the glove. While prior art heat generating systems have previously required vigorous movement to activate particles, here, such movement is not necessary. As described above, the controlled-response elements can then be tuned to a particular resonant frequency if desired. The input energy can optionally be stored in the native format (e.g. thermal, electrical, chemical) or be converted into a transduced energy storage format for use at a later time. For example, input energy vibrations can be transduced via piezo transducer into electrical impulses and stored for long periods of time into an electrical capacitor charge and discharged later based on a thermostat function when the heating output function is desired.

From the foregoing, it shall be understood that the pads 150, 20 may be incorporated into many different types of devices, whether wearable or not. For example, the pads may be useful in certain types of housings, such as battery housings, computer housings, etc. where it may be desirable for the equipment to heat up in order to function properly, especially in cold environments. Thus, by providing any form of an excitation energy sufficient to activate the controlled-response elements, the pads 150, 250 can provide heat where needed. This may be particularly valuable where traditional types of energy, such as electricity, is scarce, and other energy forms can be utilized to activate the controlled-response elements, even speaking in the direction of the pads 150, 250 so as to generate sound waves.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

Further, it will be understood that certain features and subcombinations may be of utility and may be employed within the scope of the disclosure. Further, various steps set forth herein may be carried out in orders that differ from those set forth herein without departing from the scope of the present methods. This description shall not be restricted to the above embodiments. It is to be understood that while certain forms of the present disclosure have been illustrated and described herein, it is not to be limited to the specific forms or arrangement of parts described and shown.

The invention claimed is:

1. An interactive device, comprising:

a housing, configured to be positioned on or adjacent a heat-receiving surface, the housing comprising a plurality of controlled-response elements for outputting heat in response to the controlled-response elements receiving a first energy input;

a speaker for transmitting sound waves;

means of positioning the speaker on or adjacent the heat-receiving surface; and a controller configured to tune a first portion of the plurality of controlled-response elements based on the sound waves, wherein the first energy input comprises a sound wave from a surrounding environment.

2. The interactive device of claim 1, wherein at least a portion of the first energy input is ambient noise.

3. The interactive device of claim 1, further comprising a sensor for determining a frequency of the sound waves, wherein the controller tunes the first portion of the plurality of controlled-response elements based on the frequency of the sound waves.

4. The interactive device of claim 3, wherein the controller is further configured to tune a second portion of the plurality of controlled-response elements based on a second energy input.

5. The interactive device of claim 4, wherein the first energy input and the second energy input are not the same.

6. The interactive device of claim 5, wherein the sensor determines the frequency of the first energy input and the second energy input.

7. The interactive device of claim 6, wherein the interactive device is headphones.

8. An interactive device, comprising:

a housing, configured to be positioned on or adjacent a heat-receiving surface, the housing comprising a plurality of controlled-response elements for outputting heat in response to the controlled-response elements receiving a first energy input;

a controller configured to tune a first portion of the plurality of controlled-response elements based on the first energy input;

wherein the first energy input comprises a sound wave from a surrounding environment.

9. The interactive device of claim 8, further comprising a sensor for determining a frequency of the first energy input, wherein the controller tunes the first portion of the plurality of controlled-response elements based on the frequency of the first energy input.

10. The interactive device of claim 9, wherein the sensor determines a frequency of a second energy input, and wherein the controller is further configured to tune a second portion of the plurality of controlled-response elements based on the second energy input.

11. The interactive device of claim 10, wherein the first energy input and the second energy input are not the same.

12. The interactive device of claim 11, wherein the interactive device is headphones.

13. The interactive device of claim 12, wherein the housing comprises a first layer and a second layer, and wherein the controlled-response elements are disposed within the second layer.

14. Headphones, comprising:

a speaker for transmitting sound waves;

an ear pad configured to be positioned on or around an ear of a wearer, the ear pad having a plurality of controlled-response elements for outputting heat to the wearer in response to the controlled-response elements receiving sound waves transmitted through the air by the speaker;

a sensor disposed on the headphones, wherein the sensor determines a frequency of the sound waves; and a controller, wherein the controller tunes a first portion of the plurality of controlled-response elements based on the frequency of the sound waves.

15. The headphones of claim 14, wherein the controller tunes a second portion of the plurality of controlled-response elements based on a frequency of a second energy wave.

16. The headphones of claim 15, wherein the second energy wave is not a sound wave.

* * * * *